US006110073A

United States Patent [19]

Saur et al.

[11] Patent Number: 6,110,073

[45] Date of Patent: Aug. 29, 2000

[54] PHYSICAL FITNESS DEVICE

[75] Inventors: John Saur, Darien; James Richardson, Weston, both of Conn.

[73] Assignee: Tread Pad Partners, LLC, Darien, Conn.

[21] Appl. No.: 09/244,158

[22] Filed: Feb. 3, 1999

[51] Int. Cl.[7] ..... A63F 9/00

[52] U.S. Cl. ..... 482/8; 463/36

[58] Field of Search ..... 463/1, 33, 36, 463/6; 434/247, 250; 482/1–9, 900–902, 74

[56] References Cited

U.S. PATENT DOCUMENTS

| | | |
|---|---|---|
| 2,402,109 | 6/1946 | Williams . |
| 3,024,020 | 3/1962 | Alton . |
| 3,834,702 | 9/1974 | Bliss . |
| 4,121,488 | 10/1978 | Akiyama . |
| 4,261,563 | 4/1981 | Goldfarb . |
| 4,285,517 | 8/1981 | Morrison . |
| 4,720,789 | 1/1988 | Hector et al. . |
| 5,009,419 | 4/1991 | Streeter . |
| 5,076,584 | 12/1991 | Openiano . |
| 5,139,261 | 8/1992 | Openiano . |
| 5,584,779 | 12/1996 | Knecht et al. . |

FOREIGN PATENT DOCUMENTS

| | | |
|---|---|---|
| 2 544 109 | 4/1983 | France . |
| 3730799 A1 | 4/1988 | Germany . |

OTHER PUBLICATIONS

1994 Catalog, "Perform Better", P. 38, "Ouick Feet, Quick Hands".

Darien Times, Feb. 17, 1994, Article Parnon moves ahead with "Qick Feet".

Popular Science, Mar. 1978, p. 22, "Jogging Computer".

Advertisement form CYBEX, 1997, "The Reactor".

Advertisement from Perform Better, "Footmaster Quickness Tester".

*Primary Examiner*—Glenn E. Richmon

*Attorney, Agent, or Firm*—David P. Gordon; David S. Jacobson; Thomas A. Gallagher

[57] ABSTRACT

A physical fitness device includes a housing, at least one resilient foot pad having a plurality of stepping locations, pad switch elements activated by pressure placed upon the stepping locations of the at least one foot pad, an on-board microcomputer coupled to the switch elements, and a control panel permitting a user to interact with the device. The switch elements include a plurality of pairs of contacts beneath the stepping locations and conductive leads to the microcomputer and control panel. Each foot pad has an electrically conductive undersurface adapted to make contact with one or more of the pairs of contacts when pressure is placed upon the foot pad. The control panel, which is coupled to the on-board microcomputer and an on-board power supply, has an electronic display. The control panel can be used to select predefined programs or exercise modes from the microcomputer to be followed by the user. The programs test and improve the user's foot speed, agility, and reaction time. The microcomputer and display can preferably provide feedback to the user to indicate calories burned, time elapsed, and other fitness-related information, and also which stepping location has been stepped on or should be stepped on.

24 Claims, 11 Drawing Sheets

PHYSICAL FITNESS DEVICE

BACKGROUND OF THE INVENTION

1. Field of the Invention

This invention relates broadly to physical fitness devices. More particularly, this invention relates to a portable, self-contained, electronic physical fitness device.

2. State of the Art

The home fitness device market is rapidly growing. Each year, recreational athletes purchase billions of dollars worth of physical fitness devices. The most popular types of devices have included treadmills, stationary bikes, and alpine skiers. However, these devices have several shortcomings. First, high quality devices are very expensive. Second, the devices are typically large in size. These bulky, space consuming devices cannot easily be stowed. Furthermore, the large size of the devices prevents them from being easily portable. Third, the devices tend to cause boredom, as they have limited uses. For example, treadmills are typically only used for walking or jogging at a repetitive pace. Likewise, stationary bikes and alpine skiers typically do not provide a variety of activities. The result is tedious exercise. Therefore, in short term, these devices fall into disuse. Moreover, not one of the most popular devices is able to provide combined improvement of foot speed, agility, and reaction time, the skills practiced and tested in professional and collegiate athletic sports training programs.

Based upon the perceived need for a device for improving and testing speed and agility, a fitness device called Quickfeet™ was developed and sold by the applicant of the current application. Referring to prior art FIGS. 17 and 18, the Quickfeet™ fitness device 1000 includes a plywood or pressboard base 1012 and a flexible polycarbonate sheet 1014 situated over and substantially parallel with the base. The upper surface of the base 1012 is coated with an electrostatic paint 1016 at preselected locations. The upper surface of the polycarbonate sheet 1014 includes indicia 1015 corresponding to 'stepping' locations, while the lower surface of the polycarbonate sheet 1014 includes an electrostatic painted surface 1018 beneath each stepping location. Foam rubber 1020 is interposed between the base 1012 and the polycarbonate sheet 1014 to form an inner frame which underlies the pattern formed by the 'stepping' locations 1015. An outer frame 1024 holds the base 1012 and polycarbonate sheet 1014 in a 'floating' relation to each other about the inner frame 1020. The electrostatic paint surfaces 1016 and 1018 are coupled to an out-board controller board 1026, which in turn is coupled to an out-board power source 1028.

When a user of the Quickfeet™ fitness device 1000 steps on the upper surface of the polycarbonate sheet 1014, the foot of the user on the sheet 1014 compresses foam rubber lengths 1020 of the inner frame adjacent the foot of the user, causing the sheet 1014 to mechanically move relative to the base 1012, and further flexes the sheet 1014. The combination of the movement and flex allows the electrostatic surface 1018 on the lower surface of the sheet 1014 to contact the electrostatic paint surface 1016 on the top surface of the base 1012, and send a switch signal to the controller board 1026 which maintains a count of all switch signals; i.e., the number of steps a user makes on the Quickfeet™ device 1000. The user can try to perform complex patterns of steps, stepping on particular 'stepping' locations 1015 in a particular order in a timed fashion. Thereby, the user increases his or her speed and agility.

While the Quickfeet™ fitness device solves some of the problems of the art, it is difficult and expensive to manufacture. In addition, the mechanical movement of the polycarbonate sheet under the weight of the user could be uncomfortable, or even disconcerting, to a user. Furthermore, while the device is not extremely large, neither is it easily portable, as the device includes three separate components: the main unit including the base and polycarbonate sheet, the controller, and the power source. Moreover, the device does not provide the optimum performance and variety of activities and feedback offered by the present invention.

SUMMARY OF THE INVENTION

It is therefore an object of the invention to provide an electronic physical fitness device having no components which mechanically move relative to other components.

It is another object of the invention to provide a physical fitness device which tests foot speed, agility, and reaction time.

It is also an object of the invention to provide a physical fitness device which can be used for several physical fitness activities and which maintains the interest of the user.

It is a further object of the invention to provide a physical fitness device which is relatively small in size, light weight, and portable.

It is an additional object of the invention to provide a physical fitness device which is inexpensive to manufacture.

In accord with these objects, which will be discussed in detail below, a physical fitness device according to the invention generally includes a substantially rigid base, at least one resilient foot pad defining a plurality of stepping locations, and pad switch elements provided under the stepping locations. According to a preferred aspect of the present invention, the foot pad(s), the pad switch elements and the base are laminated together such that none mechanically moves relative to the other; only resilient deformation of the foot pads is used to close circuits. In fact, the pad switch elements are activated by deformation of the foot pad(s) caused by pressure placed thereon at one of the stepping locations. The device also includes an on-board microcomputer coupled to the pad switch elements, and a control panel permitting a user to interact with the device.

Each pad switch element includes a plurality of pairs of first and second contacts forming incomplete circuits and first and second leads respectively coupling the first and second contacts to the microcomputer and control panel. At least the underside of the foot pad(s) includes an electrically conductive material. When user weight is placed on a foot pad at any of the stepping locations, the foot pad deforms causing the electrically conductive material to make contact with one or more of the pairs of contacts and complete the circuit of the switch to thereby signal the microcomputer. The user can walk, run, dance, or otherwise step on the stepping locations of the foot pad. The control panel, which is coupled to the on-board microcomputer and an on-board power supply, has an electronic display which can display indicia corresponding to each of the stepping locations.

The microcomputer stores predefined fitness programs and the control panel can be used to select one of the programs from the microcomputer to be followed by the user. The programs or exercise modes test and improve the user's foot speed, agility, and reaction time. In addition, the microcomputer and display can preferably provide feedback to the user to indicate calories burned, time elapsed, and other fitness-related information. A handle or slot is desirably provided within the housing for carrying the portable unit.

According to a preferred embodiment of the invention, the at least one foot pad comprises five separate foot pads, each defining one stepping location and each made from a conductive rubber. The pairs of contacts and leads are conductive traces printed on an upper side of a non-conductive sheet. A non-conductive adhesive is applied over the traces, except at the location of the pairs of contacts, to couple the foot pads to the device while insulating the conductive foot pads from the traces. As described in the detailed description, below, the foot pads are configured not to bridge the pairs of contacts unless user weight is placed on the stepping locations of the foot pads.

In addition, the upper side of the foot pads are preferably provided with a plurality of raised nubs, while the underside is provided with recesses corresponding to the raised nubs. A series of air channels connect the recesses and the periphery of the foot pad. The raised nubs and recesses facilitate activation of the pad switch elements by a user and the air channels facilitate deactivation of the pad switch elements by preventing a vacuum from forming in a depressed recess. Furthermore, in addition to using the pad switch elements to interact with the device during a fitness program, the control panel is operable via the pad switch elements prior to or subsequent to a fitness program.

According to another embodiment of the invention, separate controls are provided for the control panel. In addition, a second non-conductive sheet of material is used intermediate the conductive traces and the foot pads to insulate the conductive underside of the foot pad from the traces. Holes are provided in the second sheet to permit the foot pad to contact the traces at the contact pairs when the foot pads are deformed.

In yet another embodiment of the invention, rather than a non-conductive adhesive or non-conductive sheet being used to insulate the conductive traces from the conductive foot pads, a non-conductive ink is screened over the sheet material upon which the conductive traces have been applied. The screen for the non-conductive ink prevents the ink from forming over the pairs of contacts for the switch elements.

According to an additional embodiment, the foot pads are made of a non-conductive material and no non-conductive layer (i.e., no non-conductive adhesive, non-conductive ink, or non-conductive sheet layer) is provided between the foot pads and the conductive traces. A plurality of electrically conductive bridges for connecting the contact pairs is provided on the underside of each foot pad for completing the switch when the foot pad is deformed.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
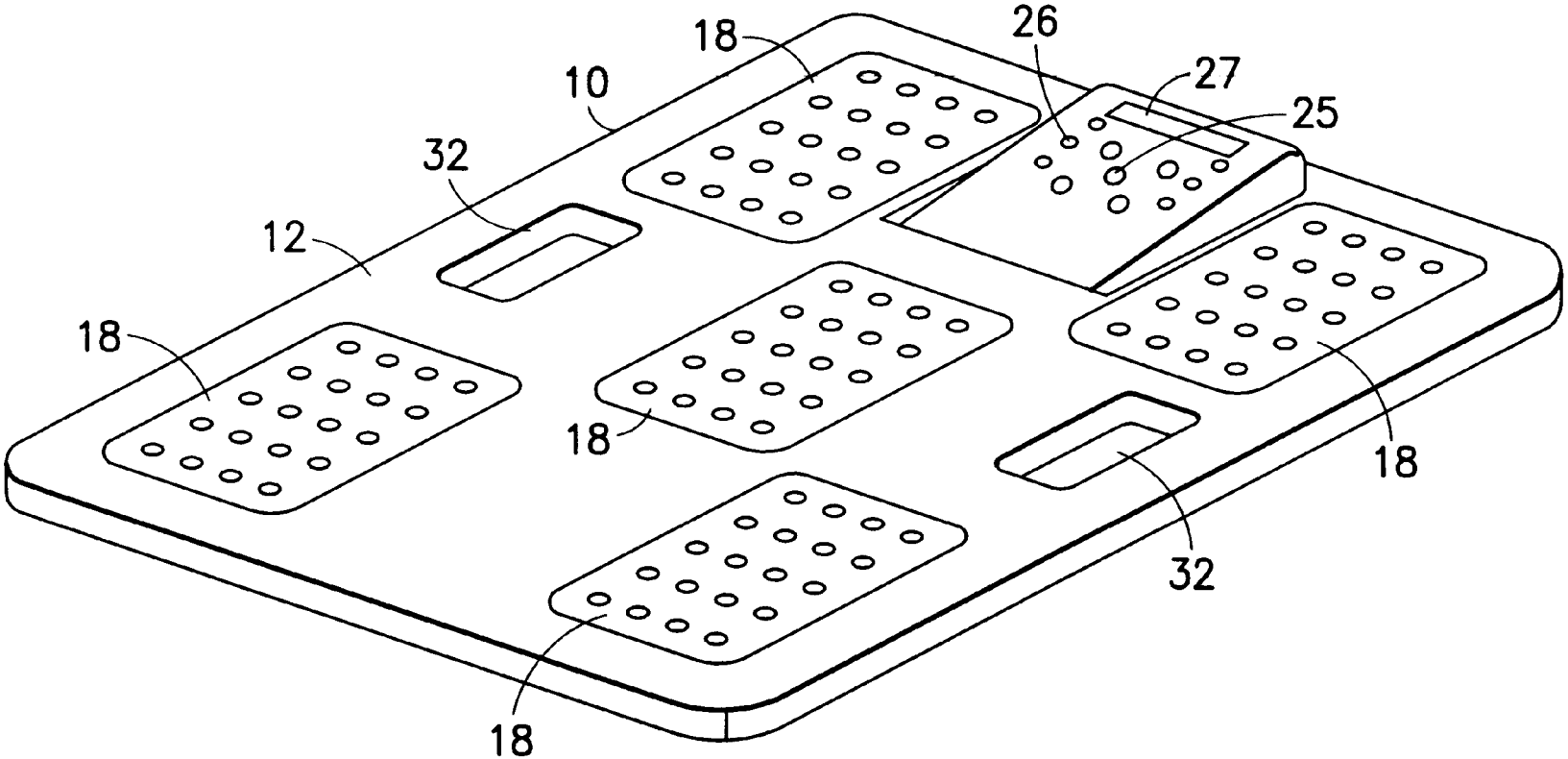
FIG. 1 is a perspective view of the physical fitness device of the invention.
Figure 2:
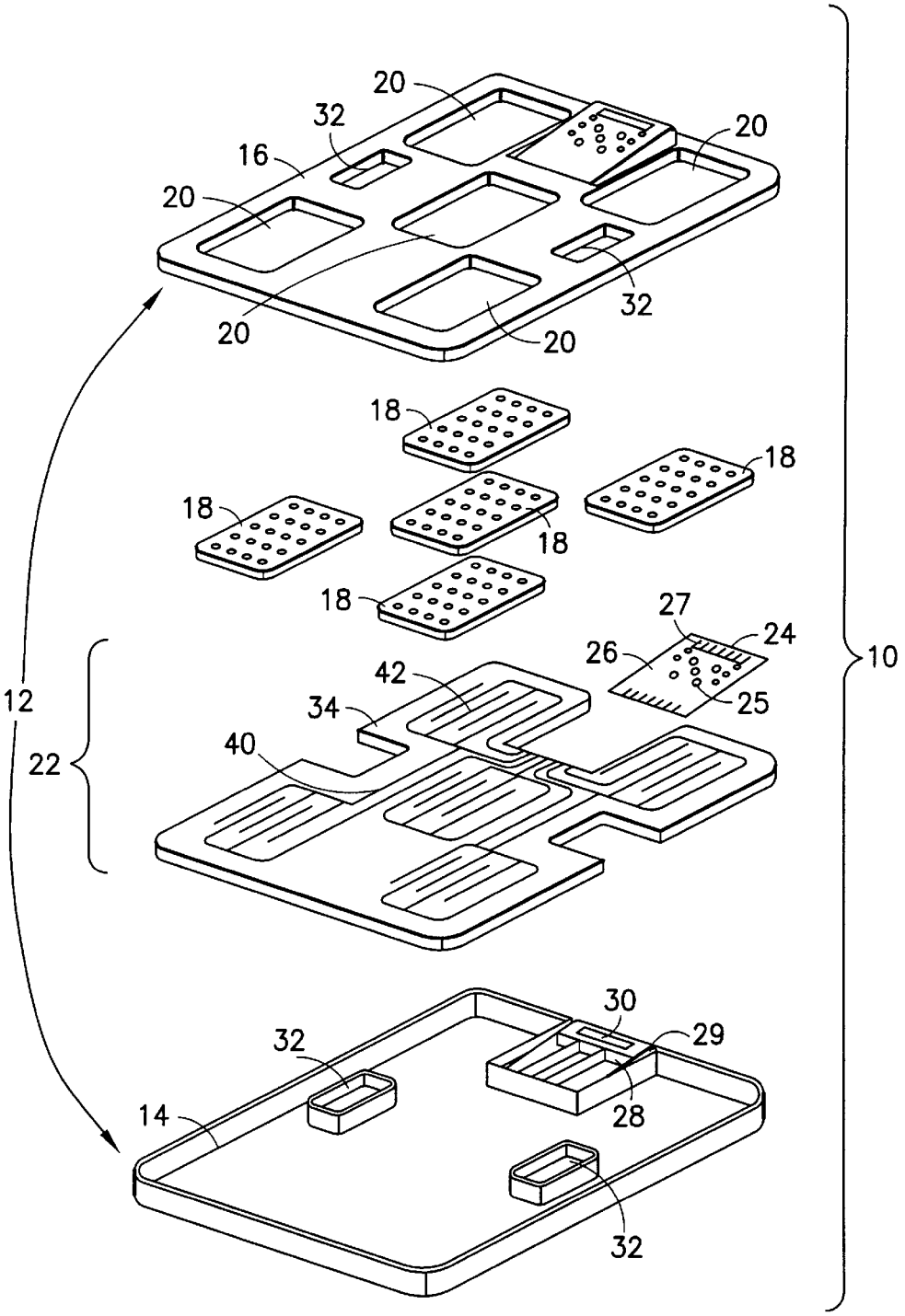
FIG. 2 is an exploded perspective view of a first embodiment of the invention.

Turning now to FIGS. 1 and 2, a first embodiment of a physical fitness device 10 according to the invention generally includes a housing 12 having a substantially flat base portion 14, a plurality of foot pads 18, and a switch layer 22 having a plurality of pad switch elements 42 which are activated (electrically completed) by pressure placed upon a respective one of the footpads 18, as described below. The base portion 12, the switch layer 22, and the foot pads 18 are preferably laminated together with an adhesive, as described below, such that the base portion, the switch layer, and the foot pads do not mechanically move relative to each other.

In addition, the device 10 has an on-board microcomputer 24 coupled to the switch layer 22, and a control panel 26 also coupled to the microcomputer. The control panel 26 permits a user to select one of several program modes programmed in the microcomputer 24 and has a display 27 which provides feedback to the user, as described below, and which includes pad indicia 25 to indicate when each of the pad switch elements 42 has been activated. The microcomputer 24 and the control panel 26 are preferably provided on a single board.

Referring to FIG. 2, an important feature of the invention is that the base portion 14 is provided with a controller compartment 28 which holds the microcomputer 24 and control panel 26, and a power source compartment 29 which holds an on-board power source 30, such as batteries, to make the device 10 self-contained. It is also preferable to provide a substantially flat cover portion 16 over the switch layer 22. The cover portion 16 is preferably laminated to the switch layer, but may otherwise be coupled to the base portion 14 to form a composite housing 12. The cover portion is provided with a plurality of upper openings 20, with individual foot pads 18 accessible through each of the openings 20. In addition, another important feature of the device 10 is that the housing 12 is provided with (e.g., molded) handles 32 for carrying the device 10. The base portion 14 and cover portion 16 are preferably made from polyolefin, polyurethane, polypropylene, polyethylene, or ABS plastic, though other substantially rigid materials can be used.

Figure 3:
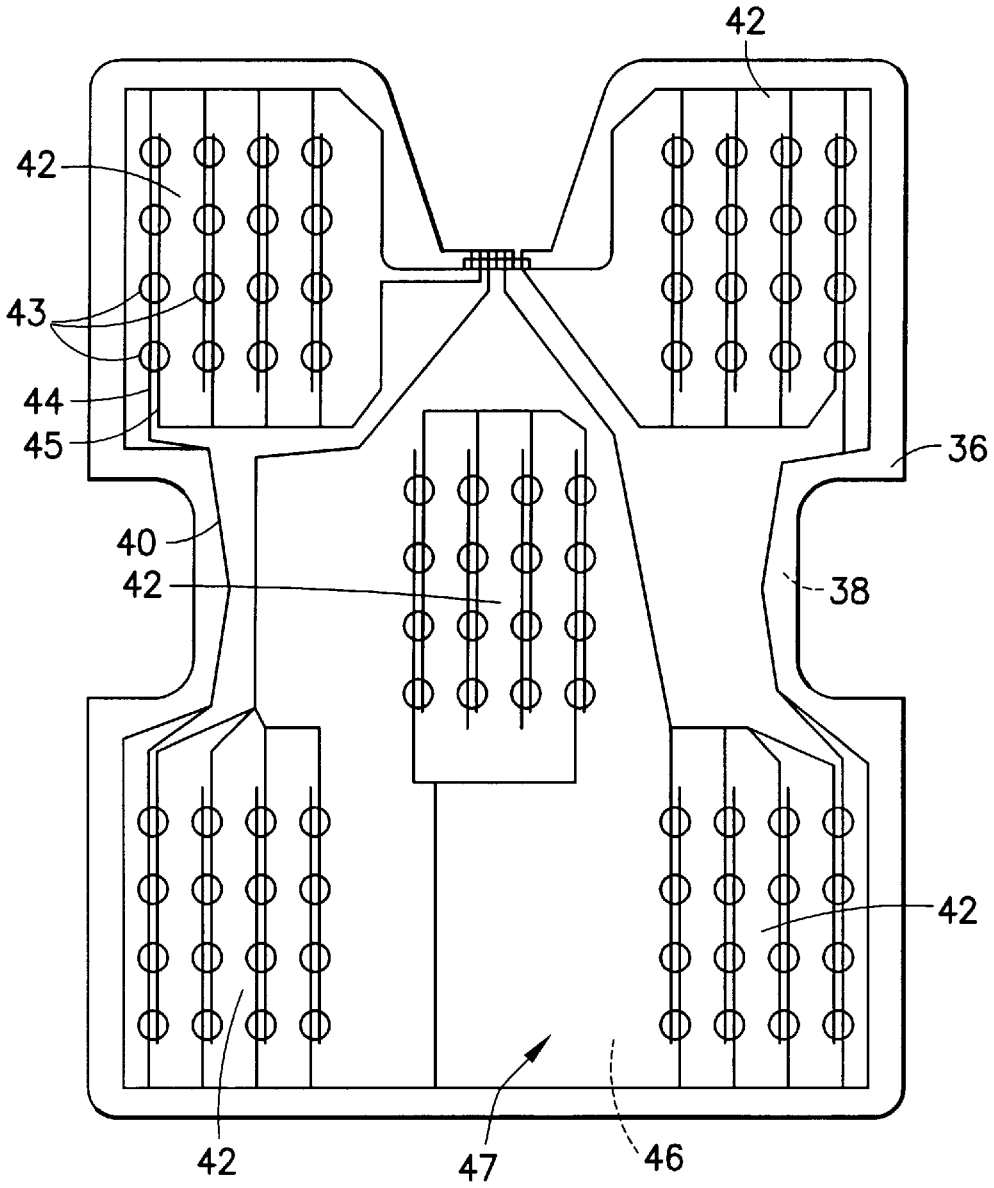
FIG. 3 is a top view of a non-conductive sheet having conductive traces thereon according to the invention.
Figure 4:
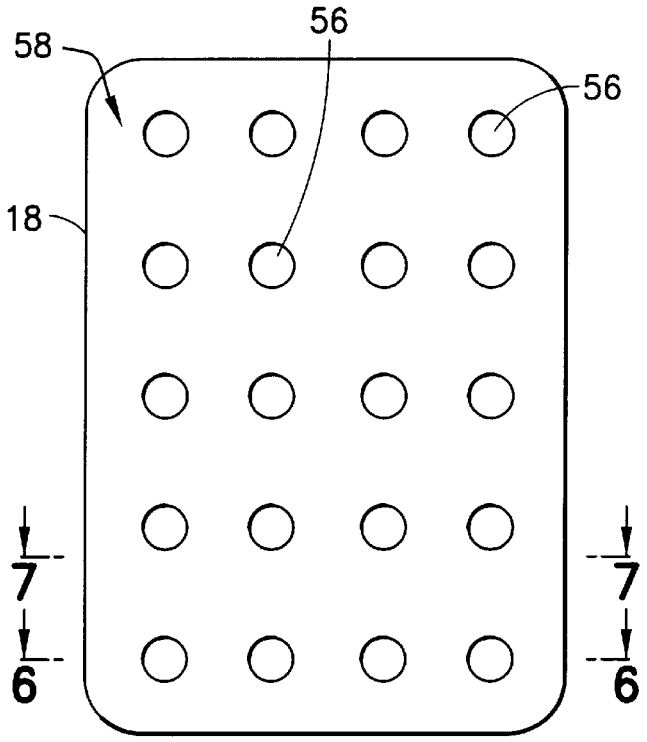
FIG. 4 is a top view of an upper surface of a foot pad according to the invention.

Referring to FIGS. 2 and 3, the switch layer 22 preferably comprises a substantially non-conductive sheet 34 having an upper surface 36 and a lower surface 38, and conductive traces, e.g. 40, on the upper surface 36. The sheet 34 is preferably made from mylar and has, e.g., a 4 mil thickness. The conductive traces 40 are preferably screen printed with conductive ink to form the pad switch elements 42 and are provided beneath the location of each foot pad 18. Each switch element 42 comprises a plurality of electrically parallel pairs of contacts 43 coupled by electrically parallel leads 44, 45 to the microcomputer 24. The sheet 34 is also preferably provided with an adhesive 46 substantially covering its lower surface 38 and, according to the first embodiment of the invention, a substantially non-conductive adhesive 47 covering the upper surface 36 including the leads 44, 45, but not the pairs of contacts 43. The adhesive 46 on the lower surface 38 laminates the non-conductive sheet 34 to the base portion 14 of the housing 12. The non-conductive adhesive 47 on the upper surface 36 laminates the non-conductive sheet to portions of the foot pads 18, as described below.

Figure 5:
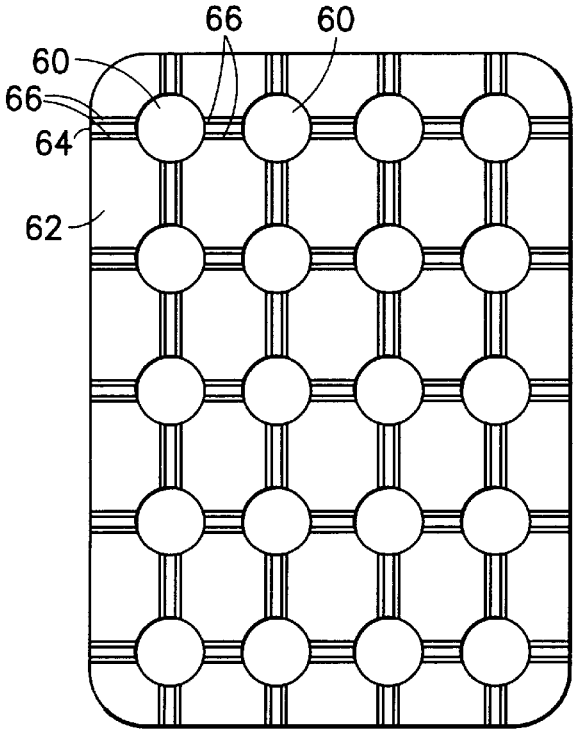
FIG. 5 is a bottom view of the lower surface of the foot pad shown in FIG. 4.
Figure 6:
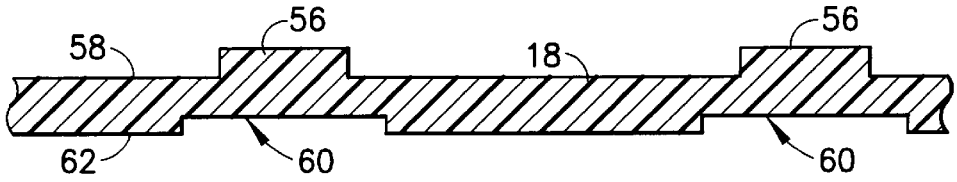
FIG. 6 is a broken cross-section through line 6—6 in FIG. 4.
Figure 7:
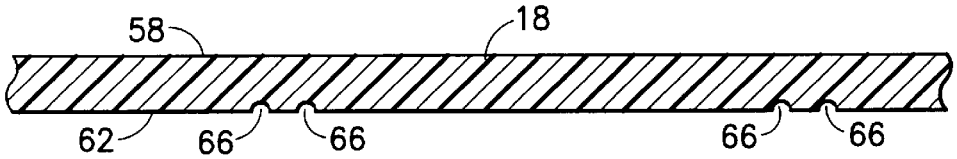
FIG. 7 is a broken cross-section through line 7—7 in FIG. 4.
Figure 8:
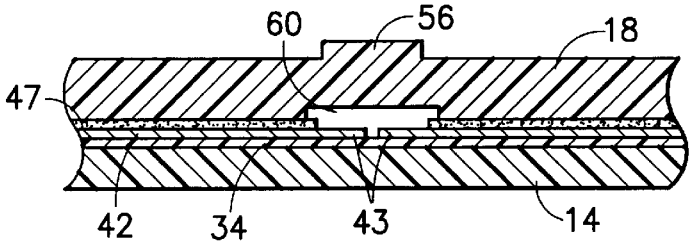
FIG. 8 is a broken cross-section of the first embodiment of the invention.
Figure 9:
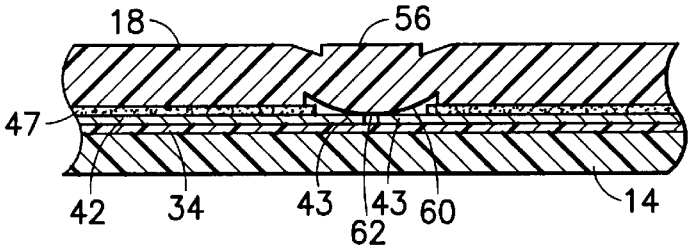
FIG. 9 is a view similar to FIG. 8 with the foot pad deformed to make contact with a switch element.

Referring to FIGS. 2 and 4 through 8, and according to a preferred aspect of the first embodiment of the invention, the foot pads 18 are made from an electrically conductive neoprene. The upper side 58 of each foot pad 18 is preferably substantially co-planar with the top of the cover portion 16 (FIG. 1). Another preferred aspect of the invention is that each foot pad 18 preferably has a plurality of raised nubs 56 (a grouping of rasied nubs 56 defining stepping locations) on its upper side 58 (FIGS. 4 and 6) and a relatively enlarged recess 60 on the underside 62 of the foot pad 18 beneath each raised nub 56 (FIGS. 5 and 6). In addition, referring to FIGS. 5 and 7, another preferred aspect of the invention is that the recesses 60 and the periphery 64 of the underside of each foot pad are connected by preferably a network of pairs of air channels 66. The underside 62 of each foot pad 18 between the recesses 60 and air channels 66 is laminated to the non-conductive sheet 34 by the non-conductive adhesive 47. Referring to FIG. 8, the nubs 56 and recesses 60 of each foot pad 18 are situated over contacts 43 of a respective switch element 42. The adhesive 47 electrically insulates the traces 40 from the conductive foot pads 18 except at the location of the pairs of contacts 43. Where there is no adhesive 47, the recesses 60 prevent the conductive foot pads 18 from bridging the pairs of contacts 43. However, as shown in FIG. 9, when foot pressure (user weight) is placed on a nub 56 of one of the foot pads 18, the foot pad is resiliently deformed to cause the underside 62 of foot pad 18 at the nub 56 to be forced through the respective recess 60. The underside 62 of the foot pad 18 at the recess 60 is thereby caused to make physical and electrical contact with respective pairs of contacts 43 of the switch element 42 located beneath the nub 56, and bridges the pairs of contacts 43 to complete the circuit of the switch element 42 and cause a signal to be sent to the microprocessor 24. In addition, as the nub 56 is depressed, air within the recess 60 is forced out of the recess and through the air channels 66 and out the periphery 64 of the foot pad 18. As pressure is released from the resilient foot pad 18, air re-enters the recess 60 through the channels 66 to permit the foot pad 18 to quickly recover the shape it had prior to pressure being placed upon it.

Referring back to FIGS. 1 and 2, the microcomputer 24 includes exercise and fitness drill software programs (fitness programs), examples of which are described below, for aerobic exercise and drills for developing and measuring raw motor speed, agility, and reaction time which can be performed on the fitness device of the invention. In addition, the weight of a user can be input into the microcomputer 24 through the control panel 26 (or a scale may be built into the device 10), and the microcomputer can provide fitness feedback (calories burned, distance run, speed, elapsed time, etc.) for a current training session and over an extended time. In addition, preferably the microcomputer 24 can store data with respect to more than one user.

The control panel 26 is operable to choose one of the fitness programs and preferably also to power on the device 10. According to the first embodiment of the invention, the controls for operating the control panel are the pad switch elements 42. For example, where the fitness device 10 includes five foot pads 18 arranged in an X configuration (as shown in FIG. 1), stepping on the center foot pad to activate its respective pad switch element 42 preferably causes the device to turn on, while stepping on the upper and lower left foot pads preferably causes the device to scroll through (and shown on the display 27) various functions such as exercise and drill programs, which of several users is to use the device, etc. In addition, the center foot pad can preferably be used to then select the desired program (e.g., aerobic mode), user (User 1, User 2) or function (weight input). The upper and lower right foot pads can be used to enter data, for example, the user weight, by scrolling up and down through a range of weights shown on the display 27. In addition, as the device preferably can store data with respect to more than one user, specific information, particularly the weight of the user, need only be entered the first time the user uses the device and will thereafter be recalled once the user selects his or her user number. The electronic display 27 preferably displays numerical data corresponding, for example, to calories burned, distance run, speed, elapsed time. In addition, the pad indicia 25, preferably a plurality LEDs, are arranged in the same pattern as the foot pads 18 and indicate when each of the foot pads 18 has been activated. Also, depending upon the fitness program being used, the pad indicia 25 can also indicate which foot pads 18 need to be stepped on and in which order. According to the preferred embodiment, inactivity by the switch elements 42 (i.e., no switch signals being sent to the microcomputer 24) over a predetermined period of time, e.g., three minutes, causes the microcomputer 24 to power off the device 10.

With respect to the aerobic exercise and drills for developing and measuring raw motor speed, agility, and reaction time, the following are examples of various drills which can be performed with the device 10. As the following are only examples, it should be appreciated that other fitness programs can be stored in the microcomputer 24 to permit the user to perform yet other exercises and drills. In an aerobic exercise mode, the user runs or dances on the foot pads 18 in any sequence and at any pace for a period of time sufficient to get his or her heart rate into a target zone for his or her respective age. In an aerobic feedback mode, the display 27 of the control panel 26 displays calories burned, distance run, speed, elapsed time, etc. In a count drill, the fitness device measures how many times the user can activate the switch elements 42 (i.e., step on the foot pads 18) during a pre-set time period, or conversely, the time to activate a pre-set number of switch elements 42. This drill measures and develops raw motor speed. In a sequence drill, the fitness device 10 measures the number of pre-set patterns (a sequence of switch elements 42) the user can complete in a pre-set time, or conversely, the time required to activate a pattern of switch elements 42 a pre-set number of times. This drill measures and develops agility. In a reaction drill, the fitness device 10 measures the number of times the user can repeat various random patterns of foot pads displayed by the indicia 25, or conversely the time required to repeat one or more random patterns of foot pads.

As described, the physical fitness device 10 can be used to perform a number of different exercises and drills to develop the skills of a user in the areas of raw motor speed, agility, and reaction time. Moreover, the user may change pace, change stride length, and/or direction without adjusting the device. The variety of exercises and drills which can be performed enables the device to engage the interest of the user and prevents the disinterest which develops with respect to other fitness devices. In addition, the device is made from relatively light weight materials. As a result of the light weight of materials used in making the device, the self-contained nature of the device (i.e., the stepping portion, the microcomputer, the control panel, and the power source being in a single housing), the relatively small size of the device, and the handles on the device, the device is extremely portable. The fitness device of the invention can easily be transported back and forth to an exercise facility, moved from one part of a home to another, or stored underbed or in a closet. The device is also easily constructed, yet durable, and has no mechanically moving parts, i.e., the foot pads need only to deform to activate a switch, as all the components are laminated together. The potential for device failure is thereby reduced.

Figure 10:
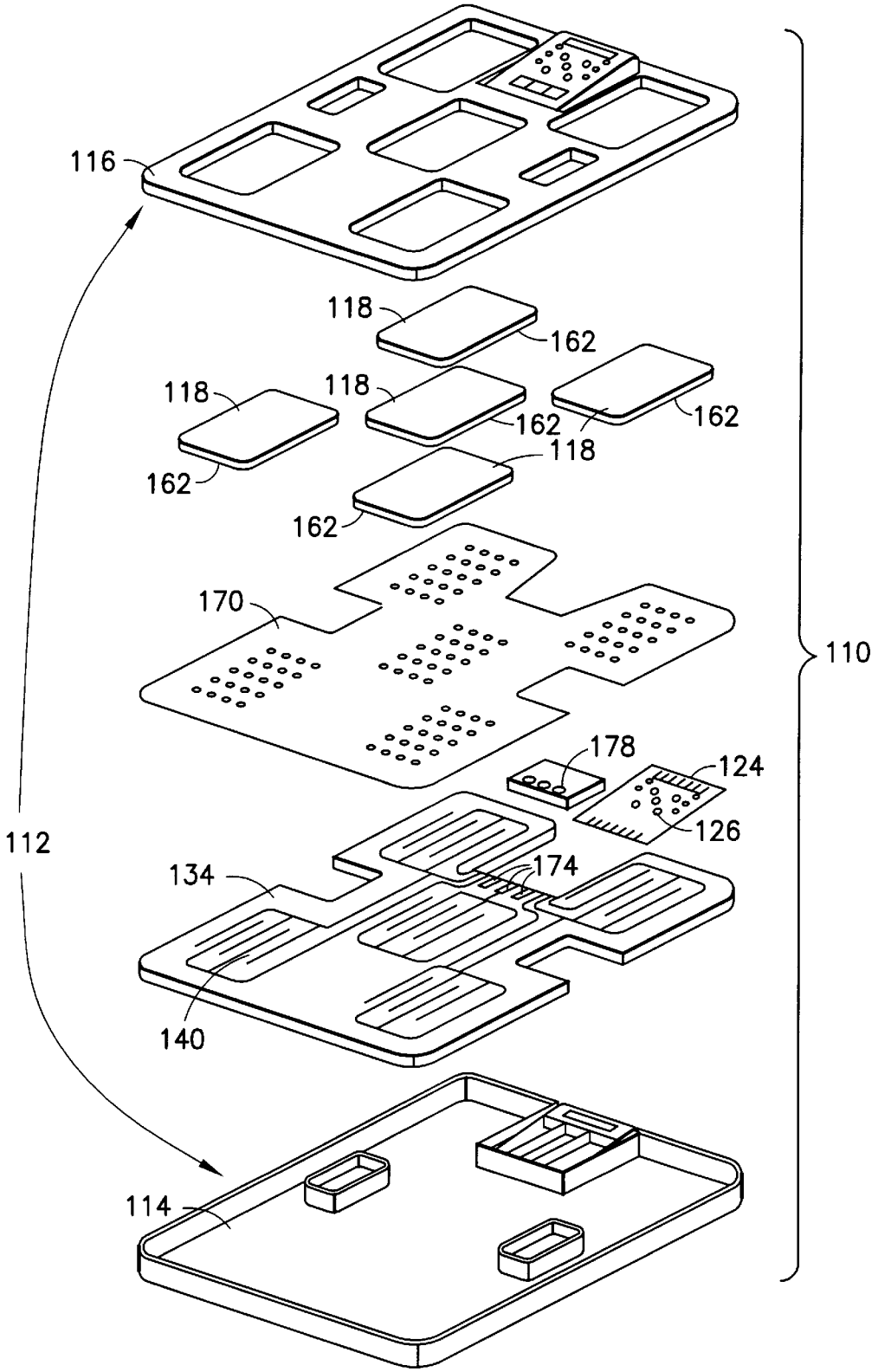
FIG. 10 is an exploded perspective view of a second embodiment of the invention.
Figure 11:
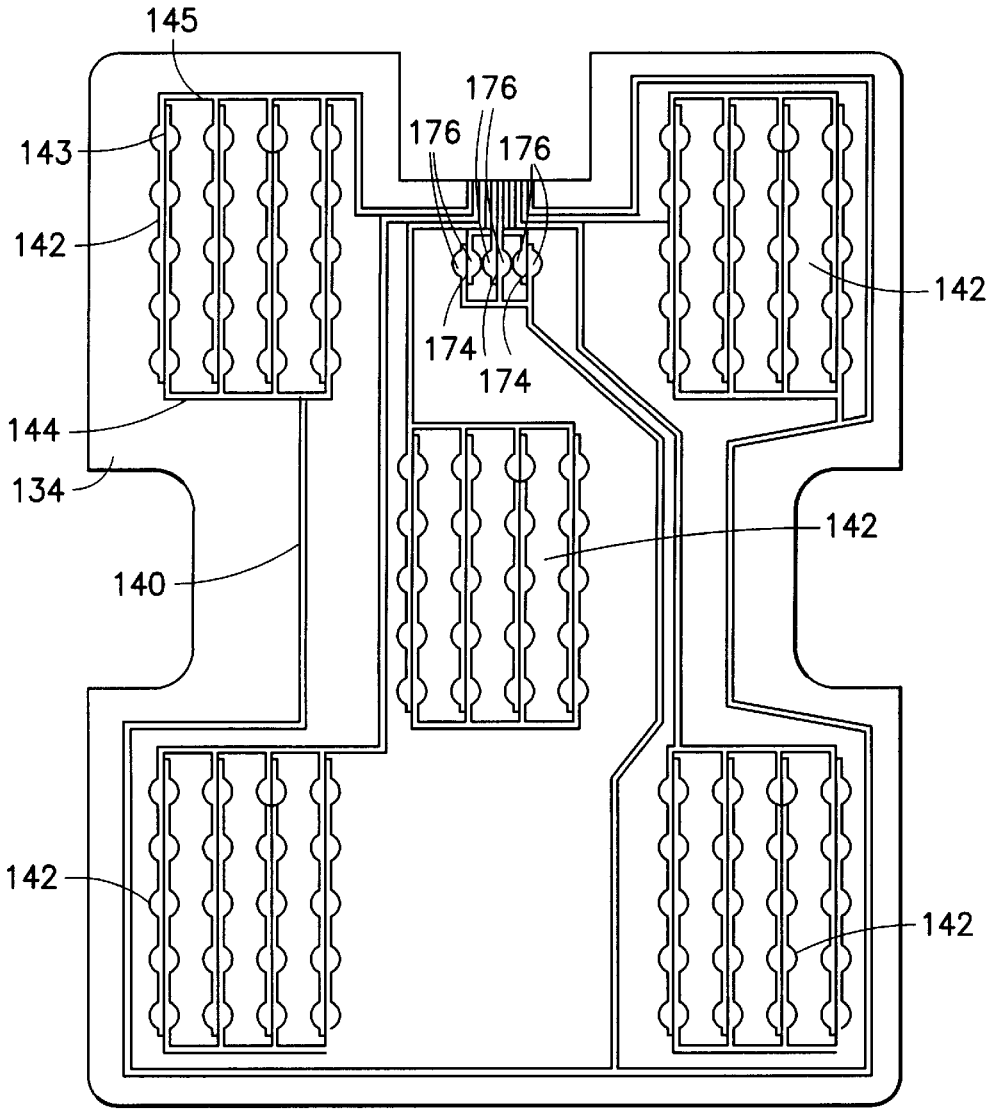
FIG. 11 is a top view of a non-conductive first sheet having conductive traces thereon according to the second embodiment of the invention.
Figure 12:
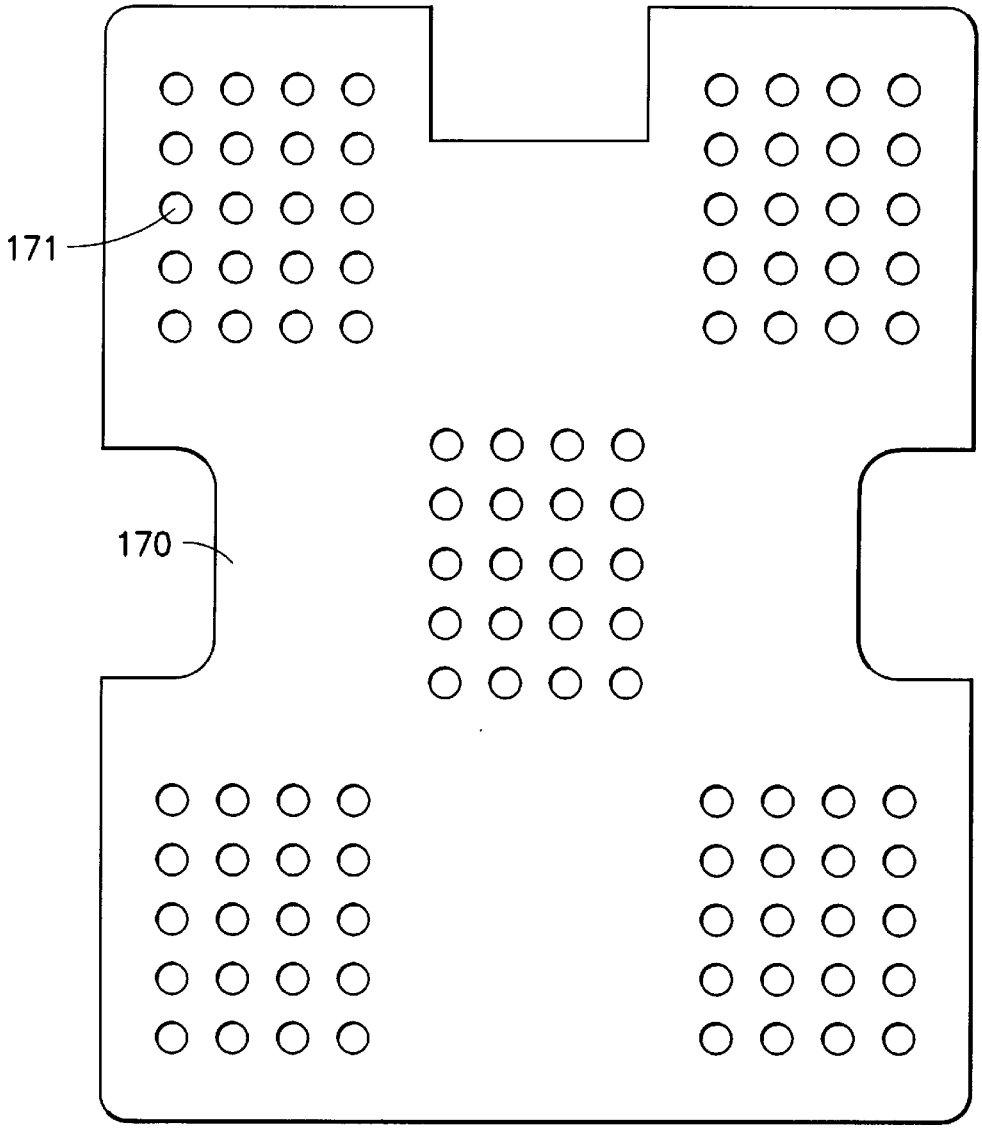
FIG. 12 is a top view of a non-conductive second sheet holes therein according to the second embodiment of the invention.

Turning now to FIG. 10, according to a second embodiment of a physical fitness device, substantially similar to the first embodiment (with like parts having numbers incremented by 100), the physical fitness device 110 includes a housing 112 having a base portion 114 and a preferably a cover portion 116, a first substantially non-conductive sheet 134 having conductive traces 140 forming switch elements 142, a second substantially non-conductive sheet 170 over the first non-conductive sheet 134, and a plurality of foot pads 118, preferably provided in openings 120 in the cover portion 116. Each foot pad 118 has a conductive underside 162. A control panel 126 is also provided, and the switch elements 142 and control panel 126 are coupled to a microcomputer 124. Referring to FIG. 11, the individual switch elements 142 each comprise a plurality of pairs of contacts 143 and leads 144, 145. Referring to FIG. 12, the second non-conductive sheet 170 is die cut to have a plurality of holes 171, each of which corresponds to exactly one pair of contacts 143. The first and second non-conductive sheets 134, 170 are preferably made from mylar sheets and are preferably laminated together with a substantially non-conductive adhesive. Likewise, the first conductive sheet 134 is laminated to the base portion 114 and the foot pads 118 are laminated to the second non-conductive sheet 170.

Figure 13:
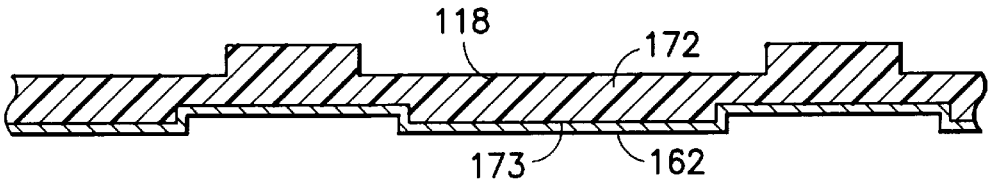
FIG. 13 is broken cross-section through a foot pad according to a second embodiment of the invention.

Turning to FIG. 13, each foot pad 118 comprises an upper layer 172 and a lower layer 173 comprising a conductive material. When a foot pad 118 is deformed, the underside 162 of the lower conductive layer 173 of the foot pad is pressed through at least one hole 171 in the second non-conductive sheet 170 to cause the pair of contacts 143 to be bridged by the lower layer and, consequently, the circuit of the switch element 142 under that foot pad to be completed.

Referring back to FIGS. 10 and 11, the first non-conductive sheet 134 also includes conductive traces which form control switches 174 comprising pairs of control contacts 176 separately coupled to the microcomputer 24. Electrically conductive control buttons 178 are provided over the first conductive sheet 134 and are accessible through the cover portion 116 of the housing 112. When each control button 178 is depressed, it bridges its respective pair of control contacts 176 to provide some functionality (e.g., user selection, weight selection, and program selection) with respect to the microcomputer 124.

Figure 14:
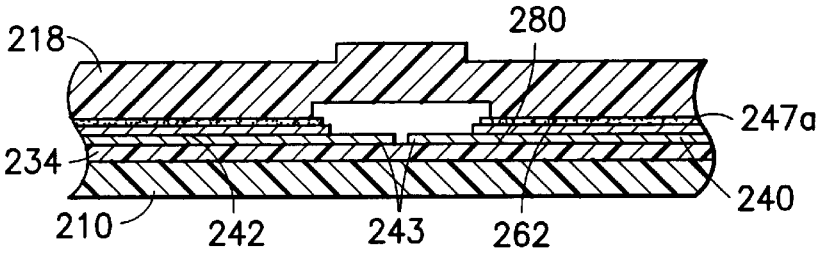
FIG. 14 is a broken cross-section through a third embodiment of the invention.

Turning now to FIG. 14, a third embodiment of the physical fitness device, substantially similar to the first embodiment (with like parts having numbers incremented by 200), includes a housing 210, a substantially non-conductive sheet 234, and conductive traces 240 forming switch elements 242 having contact pairs 243 provided on the sheet 234. A substantially non-conductive ink 280 is screened over the conductive traces 240 at substantially all locations except over the pairs of contacts 243. The non-conductive ink insulates all but the pairs of contacts from foot pads 218 having a conductive underside 262. An adhesive 247*a* is preferably provided between the non-conductive ink 280 and the foot pads 218. This embodiment provides an alternative to using a non-conductive adhesive, as described in the first embodiment, or the non-conductive second sheet and adhesive described in the second embodiment.

Figure 15:
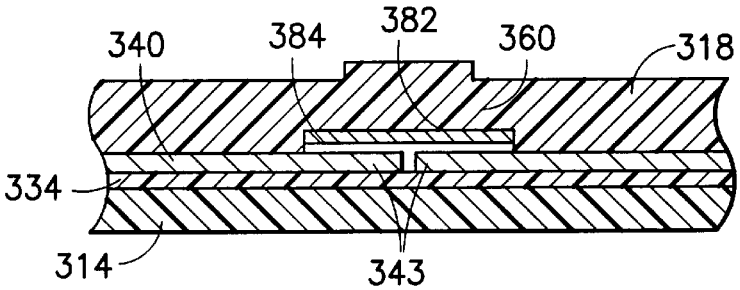
FIG. 15 is a broken cross-section through a fourth embodiment of the invention.

Turning now to FIG. 15, a fourth embodiment of the physical fitness device is substantially similar to the first embodiment described above. As described above, a substantially non-conductive sheet 334 is provided with conductive traces 340 forming switch elements 342 comprising pairs of contacts 343. However, in contrast to the previously described embodiments, the foot pads 318 are made from a substantially non-conductive material, e.g., rubber, and no non-conductive layer is provided between the non-conductive sheet 334 and the foot pads 318. The foot pads are provided with undersurface recesses 360 which have respective ceiling surfaces 382. A conductive material 384, e.g., a metallic foil, a conductive ink or paint, or a metal coupon, is provided in each recess 360. When a foot pad 318 is stepped on, the conductive material 384 on the underside of the foot pad 318 bridges at least one pair of contacts 343 beneath the respective foot pad. The foot pads 318 and the non-conductive sheet 334 are preferably laminated to a base 314.

Figure 16:
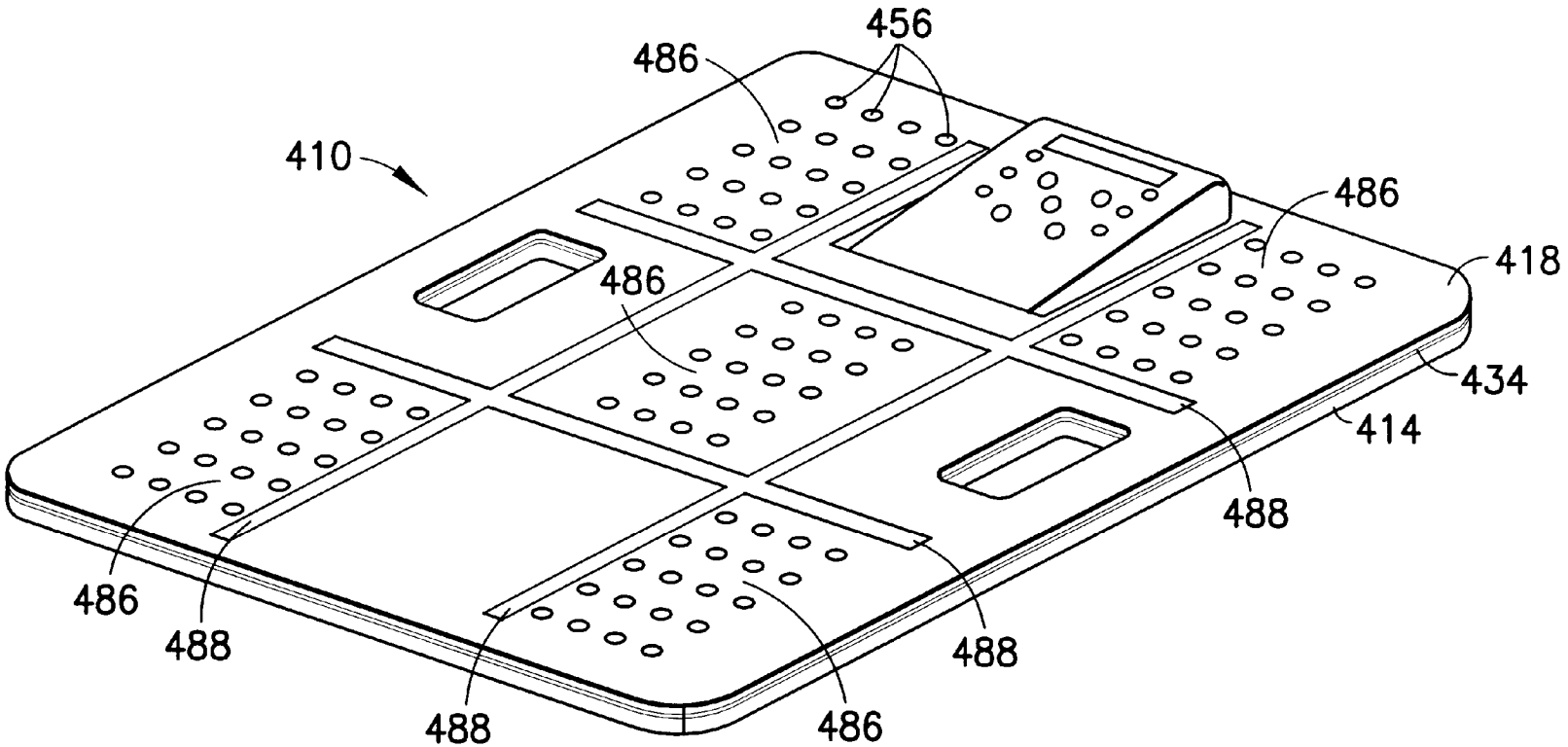
FIG. 16 is perspective view of a fifth embodiment of the invention.
Figure 18:
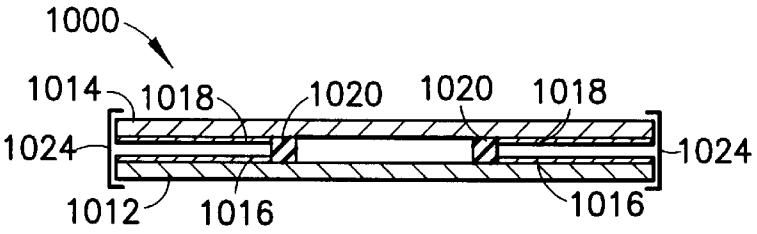
FIG. 18 PRIOR ART
FIG. 18 is a cross-section view through line 18—18 of FIG. 17.
Figure 17:
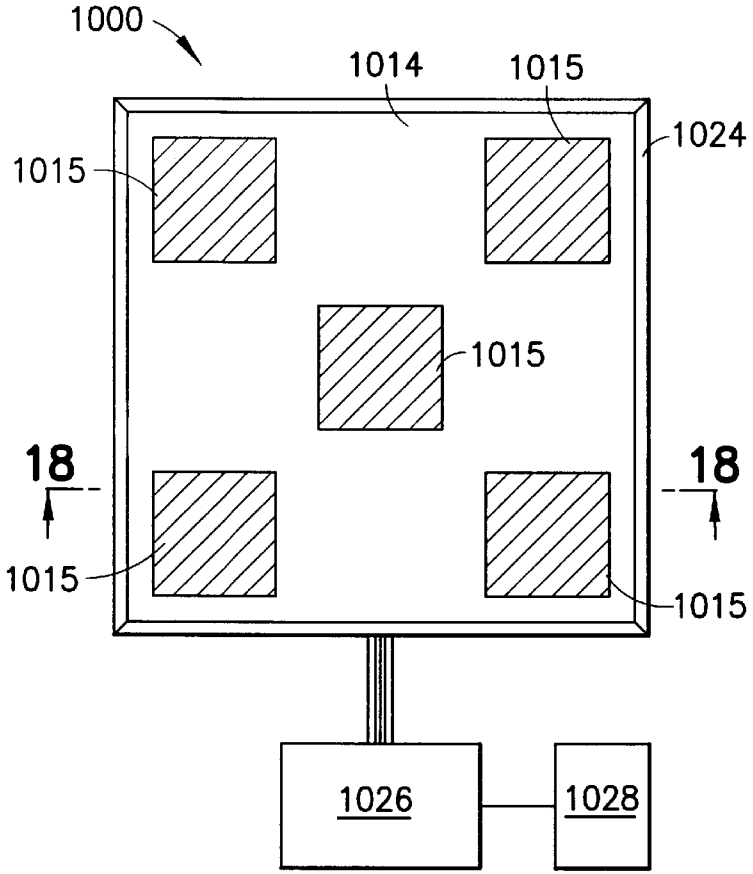
FIG. 17 PRIOR ART
FIG. 17 is a top view of a prior art fitness device.

Turning to FIG. 16, a fifth embodiment of the fitness device 410 of the invention, substantially similar to the preceding embodiments, is shown. However, in contrast to the preceding embodiments, rather than having a plurality of distinct foot pads, the device 410 is provided with a single unitary foot pad 418 having a plurality of stepping locations 486. The stepping locations 486 are preferably defined by groups of raised nubs 456, but may additionally or alternatively be defined by indicia, such as colored lines 488.

As in the previous embodiments, the foot pad 418 is laminated to a non-conductive sheet 434 having switch elements (not shown) provided thereon, which, in turn, is laminated to the base portion 414 of the fitness device 410. The stepping locations 486 of the foot pad 418 are provided over the switch elements such that pressure placed on the foot pad at any of the stepping locations 486 will cause a respective switch element to activate, as described in detail with respect to the previous embodiments.

There have been described and illustrated herein several embodiments of a physical fitness device. While particular embodiments of the invention have been described, it is not intended that the invention be limited thereto, as it is intended that the invention be as broad in scope as the art will allow and that the specification be read likewise. Thus, while particular embodiments have been disclosed to describe various features, it is intended that, to the extent such features are combinable without destroying their intended function, the features of the various embodiments described herein be used to support other combinations of the features. Also while electrically conductive foot pads have been described in several embodiments as being made from conductive neoprene rubber (i.e., neoprene rubber impregnated with carbon), it will be appreciated that other deformable and conductive materials may be used as well and that the conductive material need only be provided on the underside of the foot pad. In addition, while the foot pads have been described as preferably having nubs and recesses, it will be appreciated that while both assist in accurate performance by the device, the nubs are not required and that the recesses may be eliminated if an intervening layer (for example, the second non-conductive sheet described in the second embodiment) or space is otherwise provided between the underside of the foot pad and the switch elements. Moreover, while the air channels are very advantageous to prevent vacuum formation beneath the foot pads, the air channels are not absolutely required. Furthermore, while the switch elements and control switches are preferably formed by conductive traces printed on a substantially non-conductive sheet, it will be appreciated that the switch elements and control switches may be applied with an electrostatic paint or hardwired. Also, while the non-conductive sheets are preferably made from mylar, another material can likewise be used. In addition, while the 'power on' control has been described as being one of the pad switch elements, it will be appreciated that the 'power on' control may be a separate button, switch, or other control accessible through the housing. Moreover, while the specific arrangement of the five foot pads in an X configuration has been shown to be optimum to test speed, agility, and reaction time, it will be appreciated that fewer or more foot pads can be used in the same or different configuration. Also, while a cover portion for the housing is cosmetically desirable, it will be appreciated that a cover portion is not functionally required for the correct operation of the invention. Furthermore, where no cover portion is used, the base may be provided with recesses for the foot pads such that the foot pads and base together form a flush surface. In addition, while some exemplar exercise and drill modes have been described, it will be appreciated that other exercise or drill modes can likewise be programmed into the microcomputer. It will therefore be appreciated by those skilled in the art that yet other modifications could be made to the provided invention without deviating from its spirit and scope as so claimed.

What is claimed is:

1. A physical fitness device for use by a person, comprising:

a) a substantially rigid base;

b) a plurality of pad switch elements in said substantially rigid base and arranged in a stepping location pattern, each of said pad switch elements being associated with a respective stepping location and comprising a circuit having a plurality of points at which it can be closed at said respective stepping location;

c) at least one resilient foot pad, each said foot pad having a conductive means for closing said circuits of said plurality of pad switch elements;

d) a processor means coupled to said plurality of pad switch elements and provided with at least one fitness program; and e) display means coupled to said base for displaying information related to closing said circuits, wherein said plurality of pad switch elements are provided between said at least one resilient foot pad and said base, and wherein when the person steps on one of said plurality of stepping locations, said at least one foot pad deforms such that said conductive means contacts one of said pad switch elements to close a respective said circuit to send a signal to said processor means.

2. A physical fitness device according to claim 1, wherein:

said at least one foot pad is laminated to said plurality of pad switch elements.

3. A physical fitness device according to claim 1, wherein:

said at least one foot pad is a plurality of foot pads fixed relative to each in said stepping location pattern, each of said foot pads defining a stepping location.

4. A physical fitness device according to claim 3, wherein:

said plurality of foot pads consists of exactly five foot pads, and said stepping location pattern is substantially X-shaped.

5. A physical fitness device according to claim 3, further comprising:

f) a substantially flat cover having a plurality of openings, each of said openings being provided with one of said plurality of foot pads positioned therein.

6. A physical fitness device according to claim 5, wherein:

said cover has a top surface, and said upper surface of each of said plurality of foot pads is substantially co-planar with said top surface of said cover.

7. A physical fitness device according to claim 1, further comprising:

f) non-conductive means for preventing said conductive means of said at least one foot pad from conductively contacting said pad switch elements unless one of said at least one foot pad is stepped on.

8. A physical fitness device according to claim 7, wherein:

each of said circuits of said pad switch elements comprises a plurality of first conductive contacts, a plurality of second conductive contacts, a first lead electrically coupling said first conductive contacts together and to said processor means, and a second lead electrically coupling said second conductive contacts together and to said processor means, wherein said non-conductive means prevents said conductive means on said at least one foot pad from conductively contacting said first lead and said second lead.

9. A physical fitness device according to claim 8, wherein:

said non-conductive means comprises one of a substantially non-conductive sheet, a substantially non-conductive adhesive, and a substantially non-conductive ink, said non-conductive means being absent over said plurality of first and second conductive contacts.

10. A physical fitness device according to claim 1, wherein:

said conductive means on said at least one foot pad is an electrically conductive rubber.

11. A physical fitness device according to claim 1, wherein:

each of said at least one foot pad has an upper surface having at least one raised portion, and an underside provided with a recess under each of said at least one raised portion.

12. A physical fitness device according to claim 11, wherein:

said recess of each of said at least one foot pad has a ceiling surface, and said conductive means of said at least one foot pad is an electrically conductive material provided on said ceiling surface.

13. A physical fitness device according to claim 12, wherein:

each of said at least one foot pad has a periphery and said underside of said foot pad is provided with at least one air channel connecting each said recess to said periphery.

14. A physical fitness device according to claim 1, further comprising:

f) means for holding a power supply provided in said base, and wherein said processing means and said display means are fixedly coupled to said base.

15. A physical fitness device according to claim 1, wherein:

said display means includes a plurality of light emitting elements arranged in a pattern substantially similar to said stepping location pattern.

16. A physical fitness device according to claim 1, wherein:

said at least one fitness program is a plurality of fitness programs, and said physical fitness device further comprises, f) a control means for selecting one of said plurality of fitness programs.

17. A physical fitness device according to claim 16, wherein:

said control means comprises at least one of said plurality of pad switch elements.

18. A physical fitness device according to claim 1, further comprising:

f) a non-conductive sheet having an upper surface and a lower surface, said plurality of pad switch elements being affixed to said upper surface.

19. A physical fitness device according to claim 18, wherein:

said plurality of pad switch elements comprise a conductive ink which is screened on said non-conductive sheet.

20. A physical fitness device according to claim 18, wherein:

said lower surface of said non-conductive sheet is laminated to said base and each of said at least one foot pad is laminated to said upper surface of said non-conductive sheet.

21. A physical fitness device according to claim 1, wherein:

said base is substantially flat.

22. A physical fitness device according to claim 1, wherein:

said base is provided with an integrally formed handle.

23. A physical fitness device for use by a person, comprising:

a) a substantially flat rigid base;

b) a plurality of pad switch elements in said substantially flat rigid base and arranged in a stepping location pattern and laminated to said rigid base, each of said pad switch elements being associated with a respective stepping location and comprising a circuit having a plurality of points at which it can be closed at said respective stepping location;

c) at least one resilient foot pad laminated to said plurality of pad switch elements and having a closing means for closing said circuits of said plurality of pad switch elements;

d) a processor means fixedly coupled to said plurality of pad switch elements and provided with at least one fitness program;

e) display means fixedly coupled to said base for displaying information related to which is said circuits have been closed; and f) handle means for transporting said physical fitness device by the person, wherein when the person steps on one of said plurality of stepping locations, said closing means closes said circuit of one of said plurality of pad switch elements to cause a signal to be sent to said processor means.

24. A physical fitness device for use by a person, comprising:

a) a substantially rigid base;

b) five pad switch elements in said substantially rigid base and arranged in a substantially X-shaped pattern, each of said pad switch elements being associated with a respective stepping location and comprising a circuit having a plurality of points at which it can be closed at said respective stepping location;

c) at least one resilient foot pad, said at least one foot pad having a closing means for closing said circuits of said plurality of pad switch elements;

d) a processor means coupled to said plurality of pad switch elements and provided with at least one fitness program; and e) display means coupled to said base for indicating at least one of which of said plurality of stepping locations the person should step on and which of said plurality of stepping locations the person has stepped on, wherein when the person steps on one of said plurality of stepping locations, said closing means closes one of said circuits of said pad switch elements to cause a signal to be sent to said processor means.

* * * * *